US006588689B2

(12) United States Patent
Bond

(10) Patent No.: US 6,588,689 B2
(45) Date of Patent: Jul. 8, 2003

(54) APPARATUS FOR CRUSHING MATERIAL

(75) Inventor: Neville James Bond, Gisborne (AU)

(73) Assignee: Abon Engineering Pty Ltd., Victoria (AU)

( * ) Notice: Subject to any disclaimer, the term of this patent is extended or adjusted under 35 U.S.C. 154(b) by 0 days.

(21) Appl. No.: 10/055,807

(22) Filed: Jan. 23, 2002

(65) Prior Publication Data

US 2002/0121565 A1 Sep. 5, 2002

(30) Foreign Application Priority Data

Jan. 25, 2001 (AU) ..... PR2712

(51) Int. Cl.[7] ..... B02C 4/08; B02C 25/00

(52) U.S. Cl. ..... 241/37; 241/227; 241/293; 241/235

(58) Field of Search ..... 241/37, 186.35, 241/227, 235, 291, 293, 294

(56) References Cited

U.S. PATENT DOCUMENTS 3,037,540 A * 6/1962 Bloomquist et al. ..... 241/235
5,865,382 A * 2/1999 Bielagus ..... 241/235
6,182,914 B1 * 2/2001 Carle ..... 241/101.3

* cited by examiner

*Primary Examiner*—John M. Husar
(74) *Attorney, Agent, or Firm*—Duane Morris LLP

(57) ABSTRACT

An apparatus 10 for crushing materials such as rock, ore, coal, stone and the like includes two rolls 16A and 16B which are mounted in parallel to define a gap 18 therebetween. Chunks of material to be crushed are fed by a conveyor 12 into the nip 14 between the rolls. Each roll 16A and 16B is similar and includes longitudinally extending steps provided by outwardly extending faces and smoothly curved surface segments between the steps. When the rolls are counter-rotated at the same speed, the gap 18 is maintained substantially constant and effectively transversely reciprocates in location between limits defined by the outer extremity of the face of a step on one roll being located opposite the inner extremity of the face of a step on the opposite roll. Compared to smooth roll crushing the invention provides for greater reduction ratios to be achieved at slower rotational speeds and using smaller diameter rolls.

17 Claims, 5 Drawing Sheets

APPARATUS FOR CRUSHING MATERIAL

TECHNICAL FIELD

The present invention relates to an apparatus for crushing material such as rock, ore, coal, stone and the like. This results in material of reduced size that can be stored or further processed. The apparatus for crushing material has particular application to the crushing of rock and ore in mining applications, however the invention is not limited to such applications and is suitable for crushing a variety of materials of the type mentioned above for different applications.

BACKGROUND

Smooth roll crushing is a technique of using an apparatus that includes two opposed rolls with a defined gap between them for crushing material. Each roll has a circular cross-section and extends longitudinally to form a cylindrical shape. The cylindrical crushing surface of each roll is usually smooth, but it is also possible for beads of welded material to be adhered to the crushing surface. In operation, an external power source drives each roll to counter-rotate, that is, one roll rotates clockwise and the other roll rotates counter-clockwise, and chunks of the material to be crushed are fed to the nip leading to the gap between the two rolls. The rotation of the rolls applies large pressures to the chunks of material in contact with the crushing surfaces, which causes the material to undergo internal stresses and fragment. Only fragments that are smaller in size than the gap defined between the rolls will pass through that gap allowing desired sized material to be obtained.

Smooth roll crushing is usually used when fine sized material is required as it is not usually suitable to process large size chunks of material. That is, smooth roll crushing generally requires quite massive rolls operating at high speeds to handle large sized chunks of feed material. Usually a size reduction of the material being crushed of only about 3:1 can be achieved. A problem exists that to increase the feed size, a large increase in diameter of the rolls is required, causing an increase in corresponding roll weight and torque requirements.

The discussion of the background to the invention herein is included to explain the context of the invention. This is not to be taken as an admission that any of the material referred to was published, known or part of the common general knowledge in this field in Australia as at the priority date of the present application.

DISCLOSURE OF THE INVENTION

The present invention provides an apparatus for crushing materials including two rolls which are mounted in parallel to define a gap therebetween whereby surfaces of the rolls define a nip leading to the gap, the rolls being counter-rotatable for crushing material in the nip, wherein each roll is similar and includes a longitudinally extending step provided by an outwardly extending face, each roll having a smoothly curved surface between the outer extremity of the face and the inner extremity of the face, and wherein the rolls are located such that upon counter-rotation at the same speed the gap therebetween is maintained substantially constant and transversely reciprocates in location between limits defined by the outer extremity of the face of the step on one roll being located opposite the inner extremity of the face of the step on the opposite roll.

It has been found that an apparatus for crushing material according to the present invention can crush large size chunks of hard material using smaller diameter rolls and lighter weight machinery at lower speeds than known smooth rolls. This results in less expensive equipment, at lower weights and size that is easier to handle and locate. Furthermore, for a given size of feed material, the invention gives an increased reduction ratio in the size of the material being crushed compared to prior art smooth rolls of the same size.

Preferably each roll includes at least two steps, wherein each roll has smoothly curved surface segments which extend between the outer extremity of the face of one step to the inner extremity of the face of a following step.

Thus each roll may have only one step, although preferably they each have at least two steps in their crushing surfaces. Ideally each roll will have four steps, although any other number of steps is possible consistent with operational requirements and limitations.

Preferably each step extends longitudinally for the whole length of a roll.

Preferably each roll includes substantially equally peripherally spaced steps.

Preferably each smoothly curved surface segment is defined, in a cross-section of the rolls, by an arc of constant radius whose centre of curvature is offset from the centre of the roll. Preferably all radii of such arcs have the same magnitude, and all arc centres are offset equally from the centre of the roll and are equally spaced radially.

In at least one embodiment of the present invention, the face of the or each step is aligned along a radius of the roll and thus the inner and outer extremities of the or each face are also aligned along the same radius. Alternatively the outwardly extending face of a step may be substantially perpendicular to the adjacent surface segments whereby the inner and outer extremities of a face of a step may not be exactly aligned along a radius of the roll. Otherwise the invention encompasses other angles for the face of a step relative to adjacent surface segments so long as a step is thereby provided.

Each roll of the invention may comprise a generally cylindrical core on which are mounted shell segments that provide the longitudinally extending step or steps and smoothly curved surface segments therebetween. Preferably each such shell segment provides each surface segment and a step is provided by adjacent shell segments. For the mounting of such shell segments on a core, each shell segment may include a protrusion and each core include complementary shaped recesses so that a shell segment can be mounted on the core by sliding the protrusion thereof into a complementary shaped recess longitudinally of the core, whereby each protrusion/recess is shaped to prevent movement of a shell segment radially of the core. Preferably at least two protrusions are provided per shell segment.

In apparatus of the invention at least one of the rolls may be resiliently biased towards the other roll whereby for excess build-up of forces within the nip, said one roll is movable against the bias away from the other roll.

For a better understanding of the present invention and to show how it may be carried into effect, embodiments thereof will now be described by way of non-limiting example only, with reference to the accompanying drawings.

DESCRIPTION OF PREFERRED EMBODIMENTS

Figure 1:
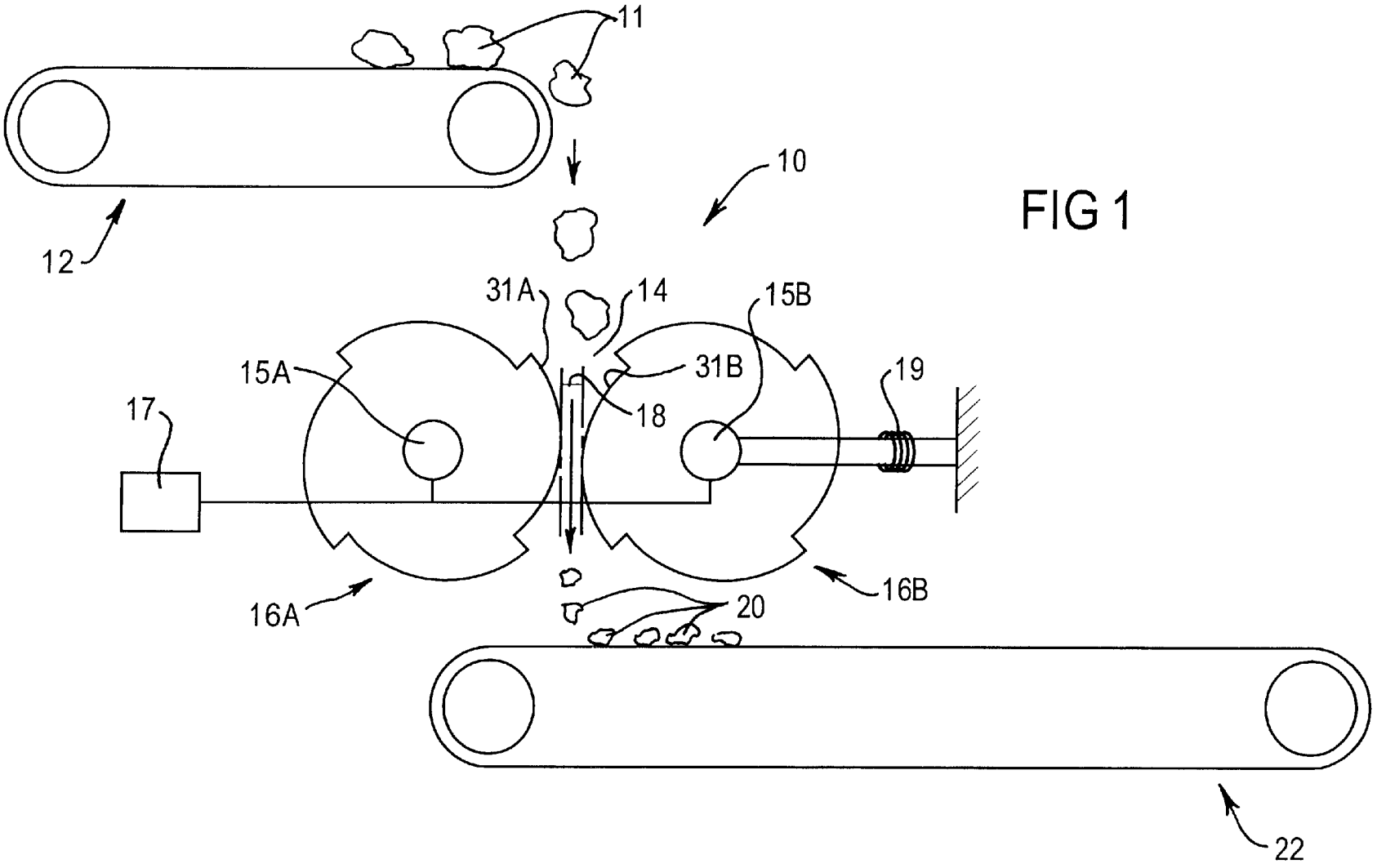
FIG. 1 is a schematic side view of material crushing apparatus according to an embodiment of the invention.

A crushing apparatus 10 (see FIG. 1) includes two rolls 16A, 16B which are mounted in parallel to define a gap 18 therebetween. Surfaces of the rolls, for example, 31A, 31B respectively, define a nip 14 which leads to the gap 18. Chunks of material 11 such as a mineral ore to be crushed are fed via a first conveyor 12 from a supply such as a hopper (not shown) and dropped into the nip 14 above rolls 16A and 16B. Shafts 15A and 15B respectively of the rolls 16A and 16B are driven by means 17 (only schematically illustrated and which may comprise an electric motor and gear box arrangement) to counter-rotate to crush the material 11 into smaller material fragments 20. Only fragments 20 that are small enough to fit through the gap 18 will drop onto a second conveyor 22 for transport to be stored or further treated. Roll 16B may be resiliently biased by means 19 such as a spring loaded ram acting on shaft 15B, towards roll 16A whereby excess build up of forces within the nip 14 will cause roll 16B to move against the bias away from roll 16A and thereby reduce forces within the nip 14. Alternatively sensors may be associated with the rolls 16A, 16B to detect a preselected underspeed of the rolls, upon which the crushing apparatus 10 automatically shut off. Additional levels of protection may also be included in the crushing apparatus 10 such as, secondly, mechanical trip switches associated with fluid couplings of the drive means 17 which respond to excessive heating of the fluid in the couplings. Such fluid couplings may thirdly include fusible plugs in the coupling housings which melt upon excessive heat build up thereby allowing discharge of the fluid and loss of the drive. A fourth level of protection may be the provision of thermal cut-outs associated with the electric motor.

The rolls 16A and 16B are similar and one of the rolls will now be described with reference to FIG. 2 but with the designations A or B omitted from the references.

Figure 2:
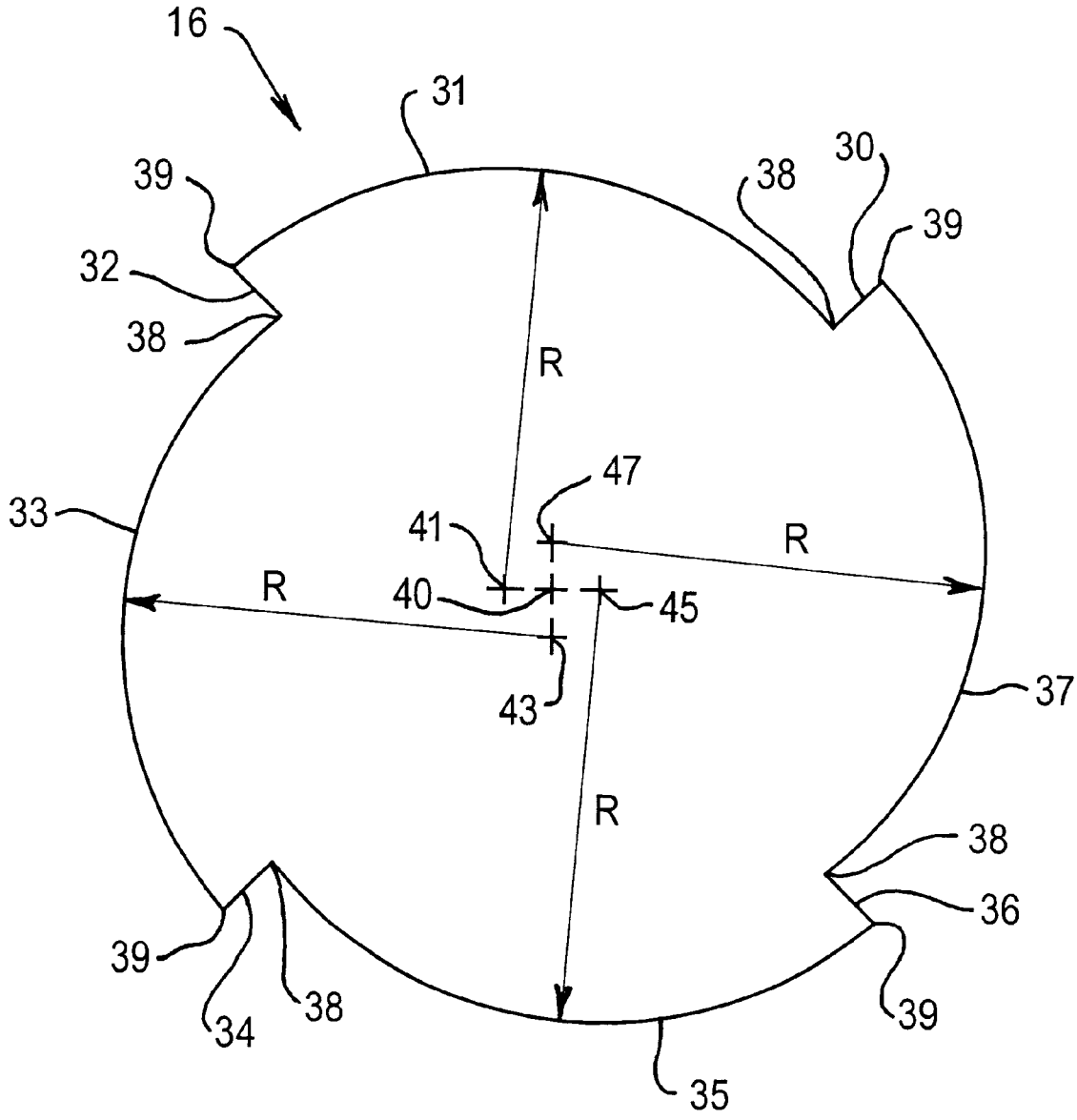
FIG. 2 is a cross-section of one roll of the apparatus of FIG. 1.

FIG. 2 is a cross-sectional view of a roll 16. Roll 16 has four steps provided by faces 30, 32, 34 and 36 which extend outwardly of the roll 16 (note that in all the figures the size of the steps relative to the roll diameter is shown exaggerated). The steps are equally spaced about the periphery of roll 16 and extend the whole length of the roll 16. Between successive steps there are convex surface segments 31, 33, 35 and 37 each of which extends from the inner extremity 38 of the face 30 of one step to an outer extremity 39 of the face 32 of the following step (step 32 "follows" step 30 when the roll 16 rotates clockwise). Each surface segment 31, 33, 35, 37 has the same circumferential profile (that is, arc length and layout) and the same radius relative to each surface segment's corresponding centre point, so that the radius R of surface segment 31 is centred about a centre point 41, the radius R of surface segment 33 is centred about a point 43, the radius R of surface segment 35 is centred about a point 45 and the radius R of surface segment 37 is centred about a point 47. The centre points 41, 43, 45 and 47 are equally spaced from the centre 40 of roll 16. The greater the distance from each centre point 41, 43, 45 and 47 to the centre 40, the greater is the height of each step as provided by faces 30, 32, 34 and 36.

It is to be understood that the steps provided by faces 30, 32, 34 and 36 need not extend for the whole length of the roll 16, also that only one step may be provided instead of four, in which case there will be a smoothly curved surface which extends from the inner extremity 38 of the face of the step to the outer extremity 39 thereof.

Figure 3:
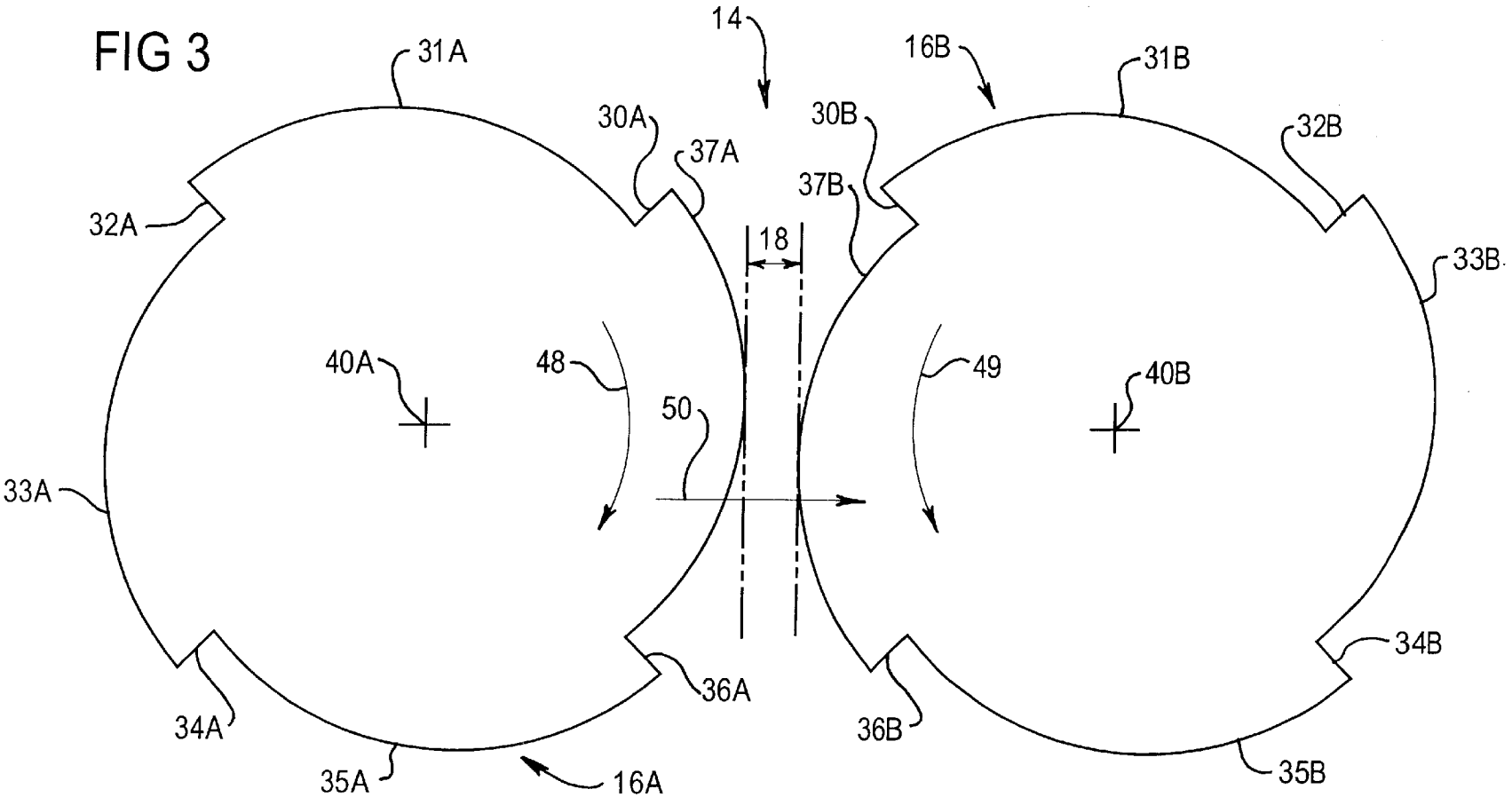
FIG. 3 is a cross-sectional view of the two parallel rolls of the FIG. 1 apparatus.

FIG. 3 shows an end cross-sectional view of the two rolls 16A and 16B of the FIG. 1 apparatus in position. Each roll is aligned so that the faces 30A, 32A, 34A, 36A of the steps on roll 16A line up with respective corresponding faces 30B, 32B, 34B, 36B of the steps on roll 16B as the respective corresponding faces rotate through gap 18. In this example, roll 16A is rotated by means 17 (see FIG. 1) in direction 48 (clockwise) about an axis along its centre 40A, and roll 16B is rotated in direction 49 (anti-clockwise) about an axis along its centre 40B. As the rolls 16A and 16B counter-rotate at the same speed, the faces 30A and 30B approach each other and the opposite surface segments 37A and 37B (as shown in FIG. 3) are such that the gap 18 effectively remains of constant size but moves transversely in direction 50 from roll 16A towards roll 16B. Chunks of material 11 falling into nip 14 are contacted by surface segments 37A and 37B which apply pressure to crush the material 11 causing it to fragment.

When the steps of face 30A and corresponding face 30B rotate to be substantially opposite each other (that is, immediately before the steps are directly opposite each other), gap 18 is at its extreme position towards roll 16B. A moment after the steps of faces 30A and 30B move past being directly opposite each other, gap 18 reverts back to its extreme position towards roll 16A. Then, as the next steps of face 32A and corresponding face 32B approach each other, the gap 18 moves again in direction 50 towards its extreme position towards roll 16B and then suddenly reverts to its extreme position towards roll 16A as the steps of faces 32A and 32B rotate past their directly opposite positioning. This continues, allowing gap 18 effectively to transversely reciprocate between two extreme positions, and the chunks of material 11 to be in constant contact with, in turn, opposing surfaces 31A and 31B, 33A and 33B, 35A and 35B, and 37A and 37B, for crushing in the nip 14 provided by these surfaces. The limits for location of gap 18 are defined by the outer extremity 39 of a face of a step 30A on roll 16A being located opposite the inner extremity of the face of step 30B on roll 16B, as the steps rotate past being directly opposite each other. It is considered that this motion of gap 18, that is, its movement in one lateral direction and sudden reversal to its extreme position in the opposite direction and then movement again in the one lateral direction, together with the "stepped" configuration of the rolls which achieves this motion, contributes significantly to an increased reduction ratio in the crushing of material that is achieved by the present invention.

Figure 4:
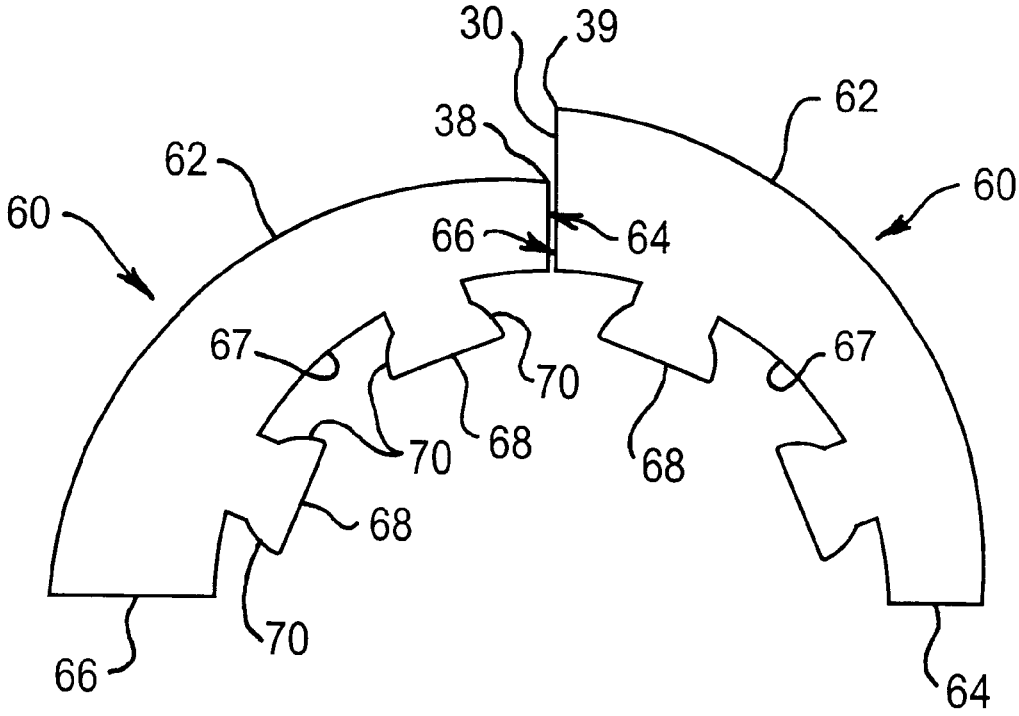
FIG. 4 shows an arrangement of two shell segments for mounting on a roll core according to another embodiment of the present invention.

Two shell segments 60 for use in another embodiment of the invention are shown in side view in FIG. 4. Each shell segment 60 has a rolling surface 62, end faces 64 and 66, and a cylindrically concave inner surface 67 from which two protrusions 68 extend. Convex rolling surface 62 is a smooth arc and corresponds to a surface segment 31, 33, 35 or 37 on a roll 16 as shown in FIG. 2.

When two shell segments 60 are mounted onto a roll core 72 (to be described below with reference to FIG. 5) they are located adjacent each other such that end face 64 of one shell segment 60 faces end face 66 of the other shell segment 60. The difference in height at this interface 64–66 provides a face 30 (or 32, 34 or 36) of a step on roll 16 as in FIG. 2. Furthermore, the top edge of end face 64 corresponds to a previously described inner extremity 38 of a said face and the top edge of end face 66 corresponds to a previously described outer extremity 39 on a roll 16 as in FIG. 2.

The protrusions 68 of each shell segment 60, by which the shell segments are mounted on a roll core 72, include opposite outwardly flared portions 70. Each roll core 72 of a pair of rolls (see FIG. 5) includes longitudinally extending recesses 74 in its outer cylindrical surface 73 which are shaped to be complementary to the protrusions 68 of shell segments 60 for a sliding fit of the protrusions 68 into the recesses 74 from an end of a roll core 72. When mounted, the concave surface 67 of each shell segment 60 contacts cylindrical surface 73 of a roll core 72 and the outwardly flared portions 70 of the protrusions within the complementary undercut portions of recesses 74 prevent movement (apart from that allowed by manufacturing tolerances) of the shell segments 60 radially outwardly of the roll cores 72. The shell segments 60 will usually have a width of about 10 cm (or other appropriate width depending on the roll diameter) such that a number of shell segments are located side by side within each recess 74 to thereby provide the steps extending longitudinally of a roll. The shell segments 60 at the ends of each roll are restrained from moving longitudinally of the roll cores 72.

Figure 5:
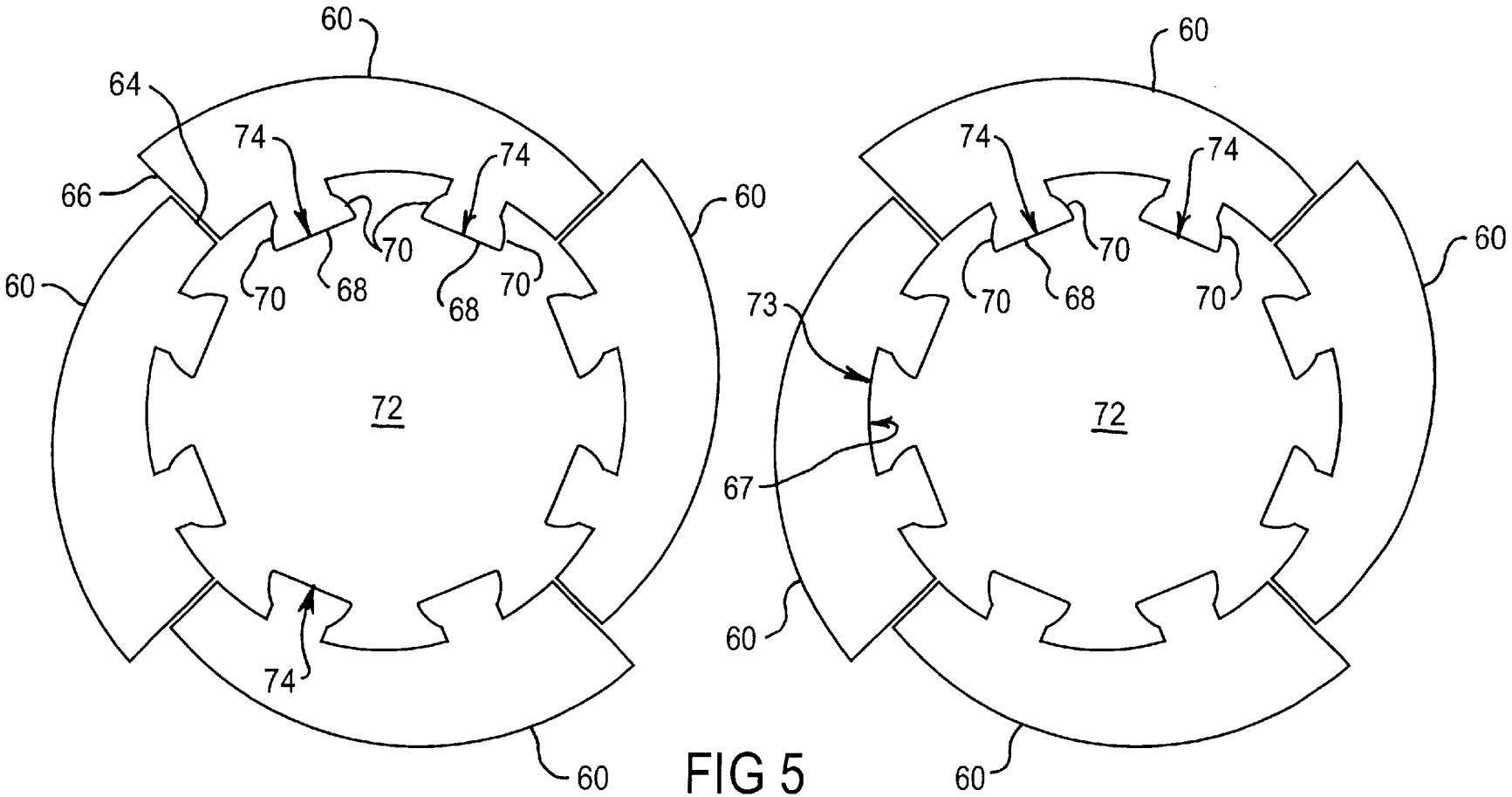
FIG. 5 is a cross-sectional view of two parallel rolls of another embodiment of the invention incorporating shell segments as shown in FIG. 4.

In an embodiment as in FIG. 5, four shell segments 60 are mounted on each roll core 72 thereby providing four steps between which smooth surface segments extend (note that in FIG. 5 the gaps between the facing end faces 64 and 66 of adjacent shell segments 60 are shown exaggerated). The protrusions 68 and complementary recesses 74 may be shaped otherwise than as illustrated in FIGS. 4 and 5, provided they fulfil the required function of maintaining the integrity of the so formed rolls for the crushing of hard materials such as rock, ore, coal, stone and the like. Also each shell segment may have only one locking protrusion instead of two, or possibly three or more locking protrusions if warranted although this is unlikely to be the case.

In tests using a prototype apparatus according to an embodiment of the invention, reduction ratios of 6:1 or 7:1 have been obtained. For example, for 600 mm diameter rolls having a step height of 20 mm, chunks of material of up to 150 mm can be crushed whereas for similar sized prior art smooth rolls, a feed size of only about 25 mm is possible. Furthermore, a 600 mm diameter roll according to an embodiment of the invention can be rotated at one eighth the speed of prior art smooth rolls for the same sized material. The smaller diameter and lower rotational speeds result in a roll that weighs less than prior art rolls. Materials that have been crushed using this apparatus to achieve reduction ratios of about 6:1 include coal, bauxite, carbon anode blocks, nickel, gold ore, concrete recycling, bricks, granite, dolarites, iron ore, limestone, niobium, clinker and basalts.

The invention described herein is susceptible to variations, modifications and/or additions other than those specifically described and it is to be understood that the invention includes all such variations, modifications and/or additions which fall within the scope of the following claims.

What is claimed is:

1. An apparatus for crushing materials including:

two rolls which are mounted in parallel to define a gap therebetween whereby surfaces of the rolls define a nip leading to the gap, the rolls being counter-rotatable for crushing material in the nip, wherein each roll is similar and includes a longitudinally extending step which is provided by an outwardly extending face, each roll having a smoothly curved surface between the outer extremity of the face and the inner extremity of the face, and wherein the rolls are located such that upon counter-rotation at the same speed, the gap therebetween is maintained substantially constant and transversely reciprocates in location between limits defined by the outer extremity of the face of the step on one roll being located opposite the inner extremity of the face of the step on the opposite roll.

2. An apparatus as claimed in claim 1 wherein the face of the step extends outwardly along a radius of a roll.

3. An apparatus as claimed in claim 1 wherein the face of the step extends outwardly substantially perpendicularly to adjacent portions of the smoothly curved surface.

4. An apparatus as claimed in claim 1 wherein each roll comprises a generally cylindrical core on which is mounted at least one shell segment that provides the longitudinally extending step and smoothly curved surface.

5. An apparatus as claimed in claim 4 wherein each roll comprises a plurality of shell segments mounted to said cylindrical core, said shell segments providing at least two longitudinally extending steps on each roll and smoothly curved surface segments between the steps, with adjacent shell segments being dimensioned such that facing end surfaces thereof provide the face of a step.

6. An apparatus as claimed in claim 5 wherein each shell segment includes at least one protrusion for mounting the shell segments on the generally cylindrical cores, the cores including longitudinal recesses for receiving the protrusions, wherein the protrusions and the recesses have complementary shapes whereby the shell segments are retained in position radially of the cores.

7. An apparatus as claimed in claim 1 wherein the step extends longitudinally for the whole length of the rolls.

8. An apparatus as claimed in claim 1 wherein each roll includes at least two longitudinally extending steps provided by outwardly extending faces and wherein each roll has smoothly curved surface segments which extend between the outer extremity of the face of one step to the inner extremity of the face of a following step so that the gap is maintained substantially constant as it transversely reciprocates on counter-rotation of the rolls.

9. An apparatus as claimed in claim 8 wherein each step extends longitudinally for the whole length of the rolls.

10. An apparatus as claimed in claim 8 wherein the steps on each roll are substantially equally peripherally spaced.

11. An apparatus as claimed in claim 8 wherein each surface segment is defined, in a cross section of the rolls, by an arc of constant radius whose centre of curvature is offset from the centre of rotation of a roll.

12. An apparatus as claimed in claim 11 wherein the radii of the arcs defining the surface segments are equal, and wherein their centres of curvature are offset equally from the centre of rotation of a roll.

13. An apparatus as claimed in claim 8 wherein the face of each step extends outwardly along a radius of a roll.

14. An apparatus as claimed in claim 8 wherein the face of each step extends outwardly substantially perpendicularly to adjacent portions of the smoothly curved surface segments.

15. An apparatus as claimed in claim 8 wherein each roll comprises a generally cylindrical core on which are mounted shell segments that provide the longitudinally extending steps and smoothly curved surface segments therebetween.

16. An apparatus as claimed in claim 15 wherein adjacent shell segments are dimensioned such that facing end surfaces thereof provide the face of a step.

17. An apparatus as claimed in claim 16 wherein each shell segment includes at least one protrusion for mounting the shell segments on the generally cylindrical cores, the cores including longitudinal recesses for receiving the protrusions, wherein the protrusions and the recesses have complementary shapes whereby the shell segments are retained in position radially of the cores.

* * * * *